US007210320B1

(12) United States Patent
Nokleberg

(10) Patent No.: US 7,210,320 B1
(45) Date of Patent: May 1, 2007

(54) LOCK GUARD SYSTEM

(76) Inventor: Albert J. Nokleberg, 3403 Timerline Dr., Eugene, OR (US) 97405

( * ) Notice: Subject to any disclaimer, the term of this patent is extended or adjusted under 35 U.S.C. 154(b) by 0 days.

(21) Appl. No.: 11/318,299

(22) Filed: Dec. 22, 2005

(51) Int. Cl.
*E05B 13/04* (2006.01)

(52) U.S. Cl. ..... 70/211; 70/416; 70/429; 292/150

(58) Field of Classification Search ..... 70/416, 70/202, 211, 429, 430; 292/148, 150, 288, 292/289, 292, 294–296
See application file for complete search history.

(56) References Cited

U.S. PATENT DOCUMENTS

| | | | | | |
|---|---|---|---|---|---|
| 1,055,510 | A | * | 3/1913 | Birkle | 70/429 |
| 1,508,091 | A | * | 9/1924 | Diesel | 292/281 |
| 1,700,135 | A | * | 1/1929 | Lanes | 70/416 |
| 1,829,444 | A | * | 10/1931 | Goebel et al. | 70/284 |
| 2,463,195 | A | * | 3/1949 | Mungan | 70/416 |
| 3,423,974 | A | * | 1/1969 | Bernsley | 70/416 |
| 3,585,827 | A | * | 6/1971 | Dominguez | 70/416 |
| 3,921,423 | A | | 11/1975 | Hollins | 70/416 |
| 4,064,721 | A | | 12/1977 | Morgan | 70/416 |
| 4,127,967 | A | | 12/1978 | Franzl | 49/171 |
| 4,279,137 | A | * | 7/1981 | Cook | 70/416 |
| 4,404,826 | A | * | 9/1983 | Brill | 70/416 |
| 4,673,202 | A | | 6/1987 | Willis | 292/162 |
| 4,869,086 | A | | 9/1989 | Richards | 70/416 |
| 4,947,663 | A | * | 8/1990 | Yeager | 70/416 |
| 4,951,982 | A | | 8/1990 | Sorkilmo | 292/343 |
| 5,003,803 | A | | 4/1991 | Richards | 70/416 |
| 5,007,263 | A | * | 4/1991 | Taylor | 70/416 |
| 5,035,128 | A | | 7/1991 | Ridgway | 70/211 |
| 5,052,202 | A | | 10/1991 | Murphy | 70/211 |
| 5,067,334 | A | | 11/1991 | Sorkilmo | 70/416 |
| 5,267,461 | A | * | 12/1993 | Eizen | 70/451 |
| 5,313,812 | A | | 5/1994 | Eklund et al. | 70/416 |
| 5,369,971 | A | | 12/1994 | Sheppard | 70/416 |
| 5,515,704 | A | | 5/1996 | van Nguyen | 70/416 |
| 5,651,279 | A | | 7/1997 | Berton et al. | 70/211 |
| 5,950,465 | A | | 9/1999 | Schultz et al. | 70/416 |
| 6,301,941 | B1 | | 10/2001 | Nicholsfigueiredo | 70/211 |
| 6,332,344 | B1 | | 12/2001 | Montoya | 70/211 |
| 6,742,369 | B1 | | 6/2004 | Veillette | 70/416 |
| 6,976,716 | B2 | * | 12/2005 | Lin | 292/288 |
| 2004/0107752 | A1 | | 6/2004 | Hicks | 70/416 |

* cited by examiner

*Primary Examiner*—Lloyd A. Gall

(57) ABSTRACT

A lock guard system for efficiently securing a dead bolt lock mechanism from outside access. The lock guard system includes a stop member comprised of a base including an upper slot and a plate that includes a lower slot for receiving a sleeve and fastener. The stop member connects to an existing dead bolt mechanism by extending the fastener and sleeve through the lower slot into an existing aperture in a covering plate. The stop member is able to adjust about the sleeve and lower slot to allow the dead bolt mechanism to operate both normally or to prevent the knob that controls the dead bolt from rotating.

20 Claims, 7 Drawing Sheets

LOCK GUARD SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to door lock devices and more specifically it relates to a lock guard system for efficiently securing a dead bolt lock mechanism from outside access.

2. Description of the Related Art

Any discussion of the prior art throughout the specification should in no way be considered as an admission that such prior art is widely known or forms part of common general knowledge in the field.

Door lock devices have been in use for years. Typically, door locks and more specifically dead bolts are accessible from both sides of a door. Usually the inside of the door has a knob for controlling the extension and retraction of the dead bolt while the outside of the door utilizes a key for controlling the dead bolt orientation. Unfortunately, dead bolt locks currently used today are able to be unlocked by those with a master key or those who can "pick" a lock to illegally gain access.

While these devices may be suitable for the particular purpose to which they address, they are not as suitable for efficiently securing a dead bolt lock mechanism from outside access. Current dead bolt locks on doors do not always stop those with master keys or those who are able to "pick" a lock from gaining access.

In these respects, the lock guard system according to the present invention substantially departs from the conventional concepts and designs of the prior art, and in so doing provides an apparatus primarily developed for the purpose of efficiently securing a dead bolt lock mechanism from outside access.

BRIEF SUMMARY OF THE INVENTION

In view of the foregoing disadvantages inherent in the known types of door lock devices now present in the prior art, the present invention provides a new lock guard system construction wherein the same can be utilized for efficiently securing a dead bolt lock mechanism from outside access.

The general purpose of the present invention, which will be described subsequently in greater detail, is to provide a new lock guard system that has many of the advantages of the door lock devices mentioned heretofore and many novel features that result in a new lock guard system which is not anticipated, rendered obvious, suggested, or even implied by any of the prior art door lock devices, either alone or in any combination thereof.

To attain this, the present invention generally comprises a stop member comprised of a base including an upper slot and a plate that includes a lower slot for receiving a sleeve and fastener. The stop member connects to an existing dead bolt mechanism by extending the fastener and sleeve through the lower slot into an existing aperture in a covering plate. The stop member is able to adjust about the sleeve and lower slot to allow the dead bolt mechanism to operate both normally or to prevent the knob that controls the dead bolt from rotating.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a lock guard system that will overcome the shortcomings of the prior art devices.

A second object is to provide a lock guard system for efficiently securing a dead bolt lock mechanism from outside access.

Another object is to provide a lock guard system that utilizes the current dead bolt assembly components.

An additional object is to provide a lock guard system that doesn't require additional drilling of the door.

A further object is to provide a lock guard system that is easily deactivated to allow normal usage.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1A:
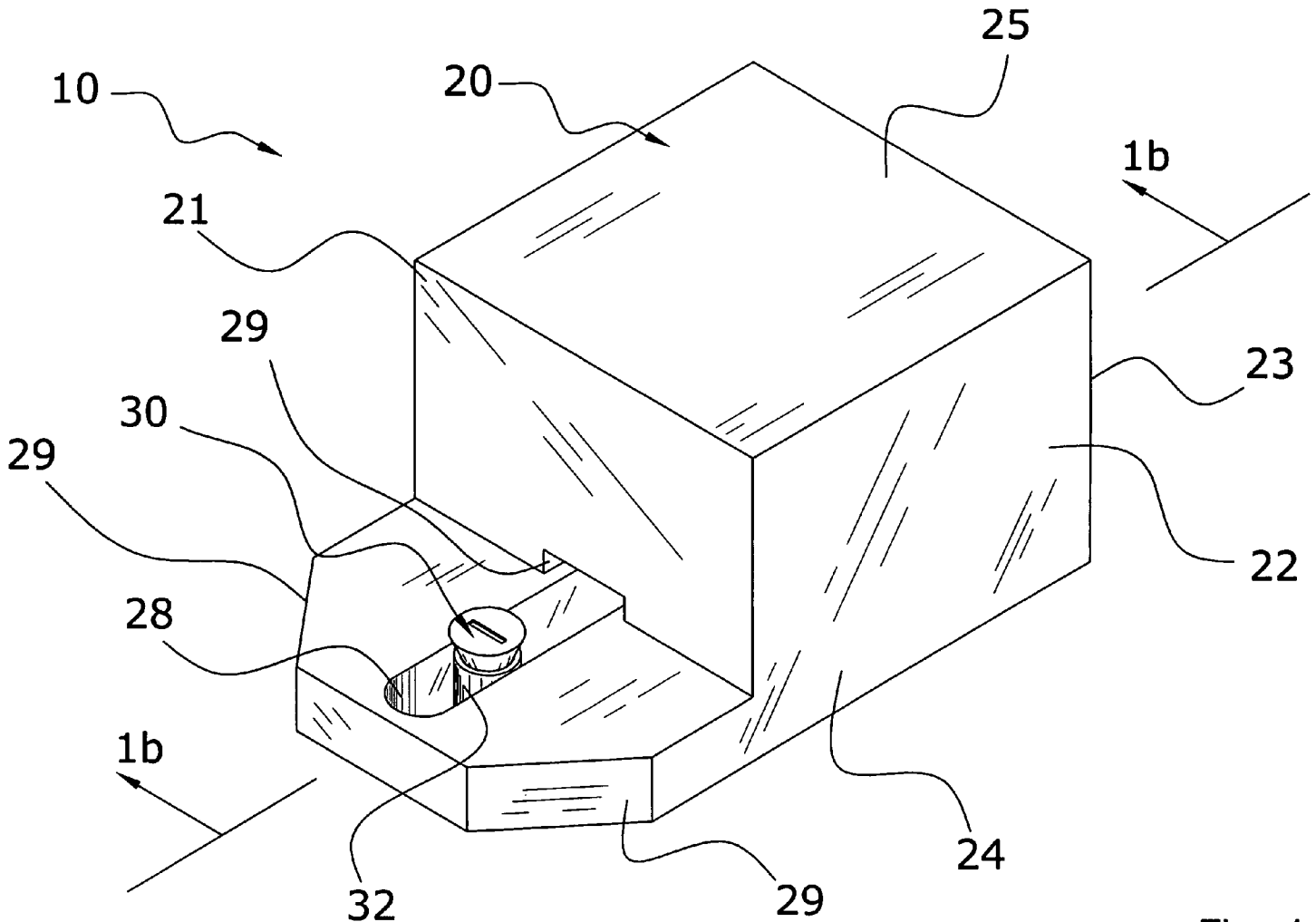
FIG. 1*a* is an upper perspective view of the present invention.

Turning now descriptively to the drawings, in which similar reference characters denote similar elements throughout the several views, FIGS. 1*a* through 4 illustrate a lock guard system 10, which comprises a stop member 20 comprised of a base 22 including a upper slot 26 and a plate 24 that includes a lower slot 28 for receiving a fastener 30 and sleeve 32. The stop member 20 connects to an existing dead bolt mechanism by extending the fastener 30 and sleeve 32 through the lower slot 28 into an existing aperture in a covering plate 17. The stop member 20 is able to adjust about the sleeve 32 and lower slot 28 to allow the dead bolt mechanism to operate both normally or to prevent the knob 12 that controls the dead bolt from rotating.

B. Stop Member

The stop member 20 is preferably made of a rigid material that will not distort when a fastener 30 is attached or when the knob 12 of the dead bolt mechanism comes in contact. The stop member 20 is preferably made of a material which will withstand contact with household cleaning solutions and long exposure to moisture and humidity such that it will not rust or absorb water. The stop member 20 may additionally be coated with a finishing material which must withstand contact with household cleaning solutions and long exposure to moisture and humidity. The stop member 20 is preferably a metal material, however, it is not restricted from being molded in a plastic or a composite material.

Figure 1B:
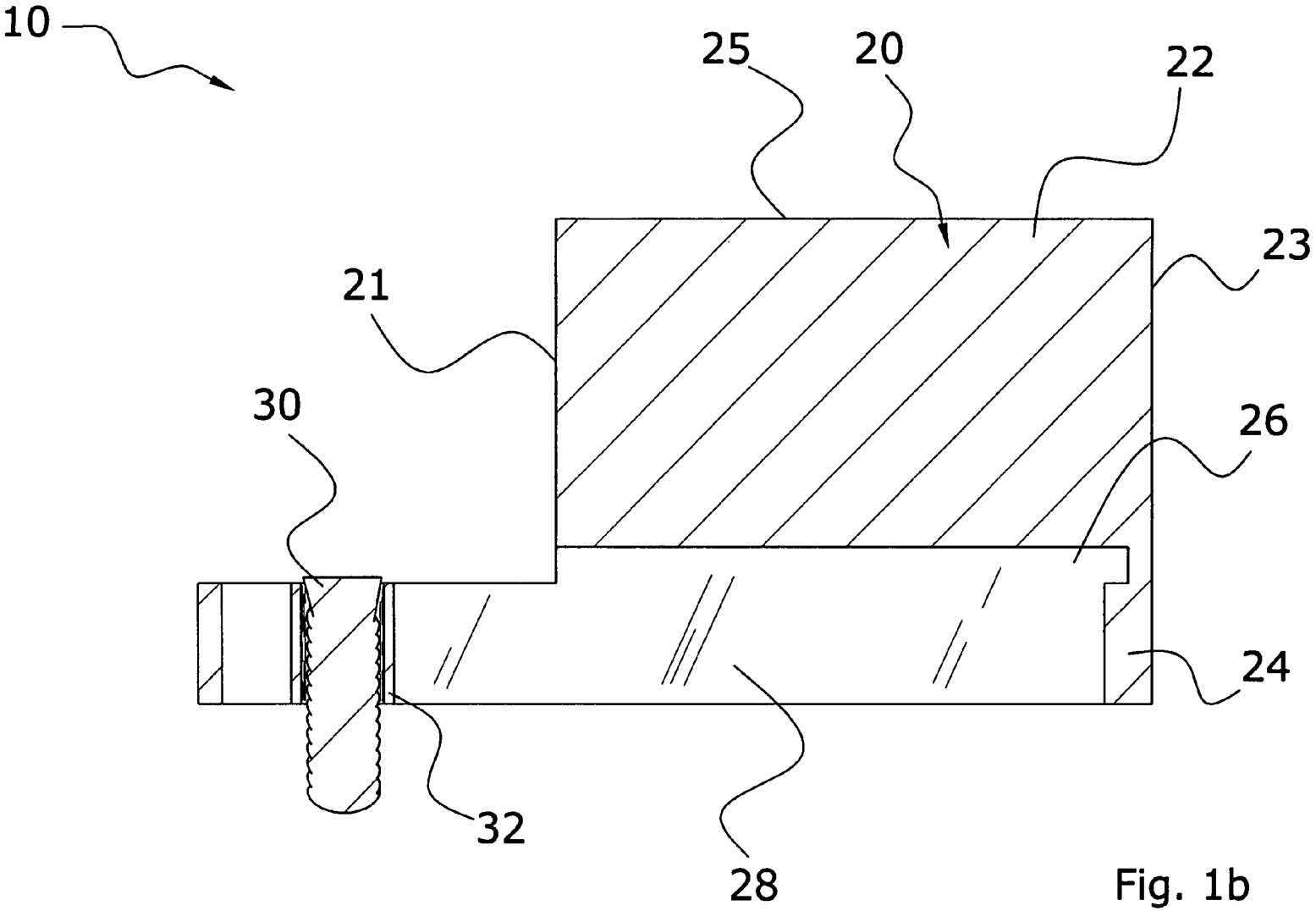
FIG. 1*b* is a cross sectional view of the present invention.
Figure 2:
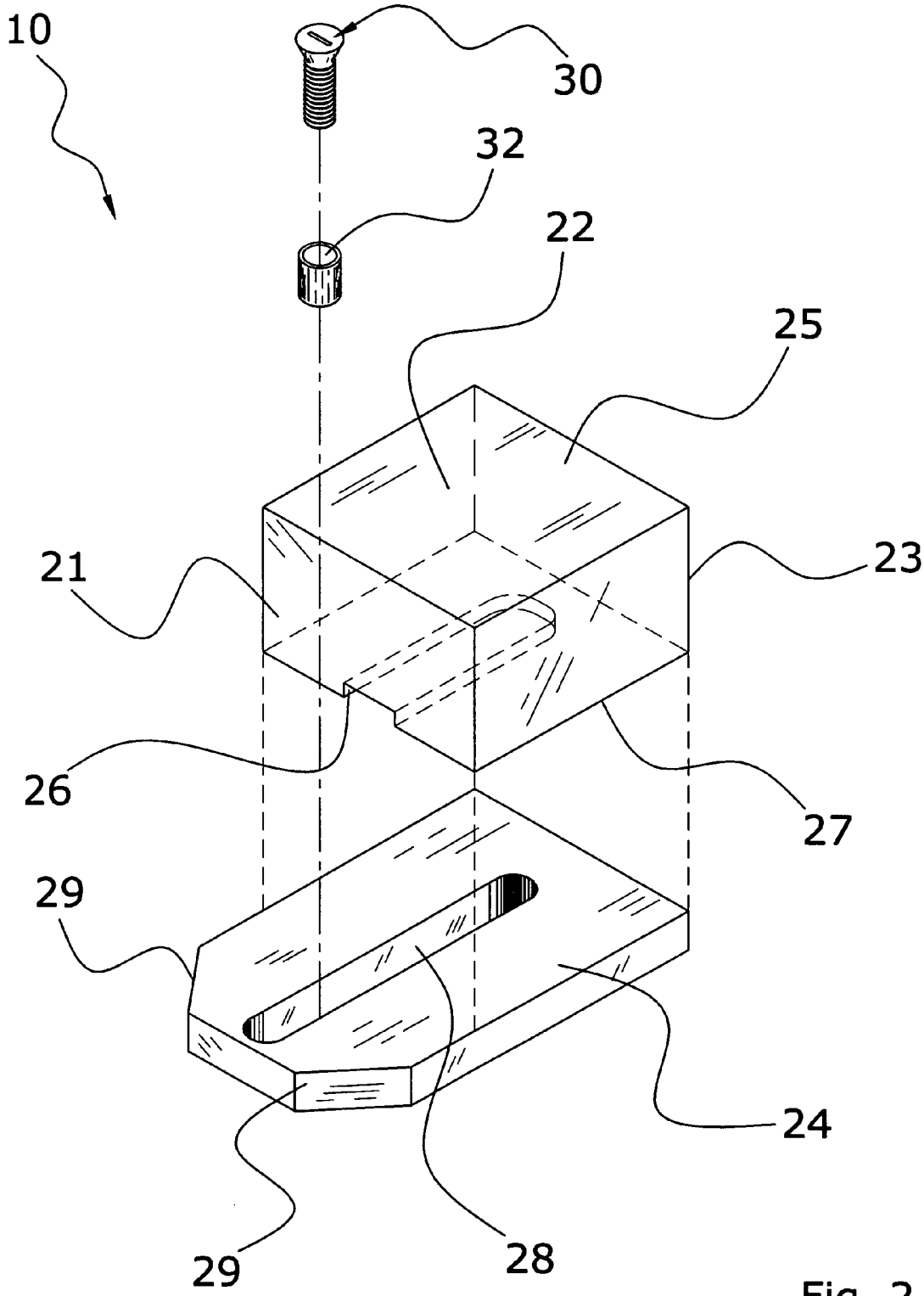
FIG. 2 is an exploded upper perspective view of the present invention.

As shown in FIGS. 1*a* through 2, the stop member 20 is comprised of a base 22 and a plate 24. The base 22 and plate 24 are constructed of similar materials. The base 22 and plate 24 are preferably integrated into one piece by a machining, molding or casting process, but it can be appreciated by one skilled in the art that a fastening method (e.g. welding or fastener) could be utilized to retain the base 22 and plate 24 together.

As shown in FIGS. 1*a* through 2, the base 22 portion of the stop member 20 is preferably cubic or box like in shape, but it can be appreciated that many forms could be utilized. An upper slot 26 extends substantially perpendicular from and through a first end 21 and towards a second end 23 which is preferably finished with a radii. The upper slot 26 also extends into a lower side 27 a desired amount towards an upper side 25 as best shown in FIG. 2. The amount of the upper slot 26 extends into the base 22 is determined by the style of fastener 30 used to retain the stop member 20. The upper slot 26 allows for clearance to the head of the fastener 30 when the lock guard system 10 is assembled and in use.

As shown in FIGS. 1*a* through 2, the plate 24 portion of the stop member 20 is preferably rectangular in shape and substantially matches the base 22 portion. A lower slot 28 extends through the plate 24. The lower slot 28 extends substantially perpendicular to the first end 21 of the base 22 in its assembled form of the stop member 20. The distal ends of the lower slot 28 may be finished in a radius, such that center lines extending through the radii of the lower slot 28 shall each lie substantially on a plane that is substantially perpendicular to the lower side 27 of the base 22 and pass through the corresponding radius of the upper slot 26 as best shown in FIGS. 1*b* through 2. As also shown in FIGS. 1*a* through 3*c*, the distal end of the plate 24 is preferably finished with multiple chamfer features 29, but it can be appreciated that other features (e.g. rounds) could also be utilized.

C. Operation of the Invention

In use, the lock guard system 10 can be utilized to additionally secure most existing dead bolt mechanisms in apartments, businesses and residential homes. However, it can be appreciated that there are many other dead bolt locking applications wherein the lock guard system 10 can be utilized. The lock guard system 10 utilizes a stop member 20 to limit the rotation of the knob 12 on a dead bolt mechanism when access is attempted from the outside 15. The lock guard system 10 provides additional protection for dead bolt mechanisms from burglars, and those with master keys 19 or copied keys 19.

Figure 3A:
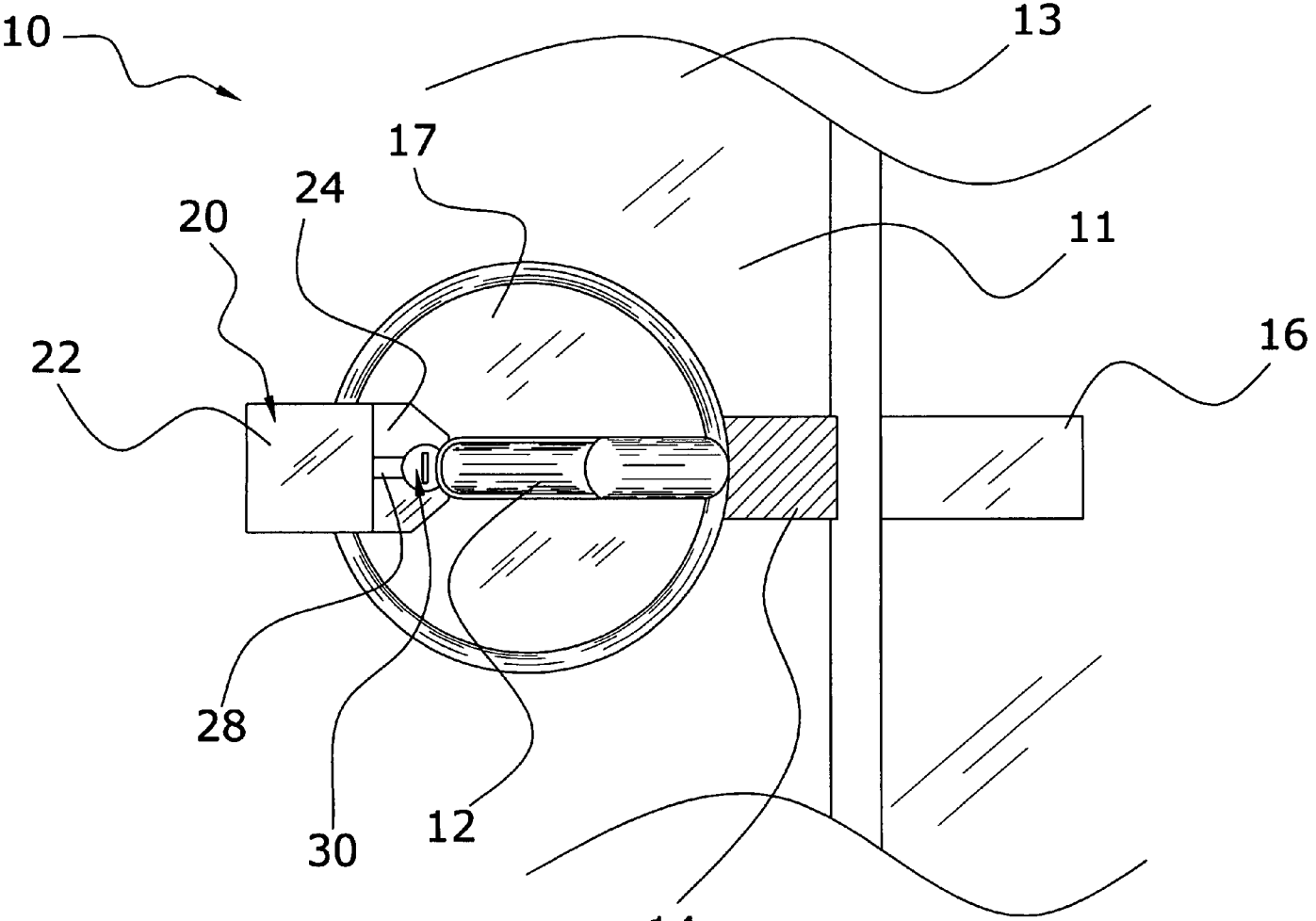
FIG. 3*a* is a front view of the present invention connected to an existing dead bolt mechanism allowing the dead bolt to open.
Figure 3B:
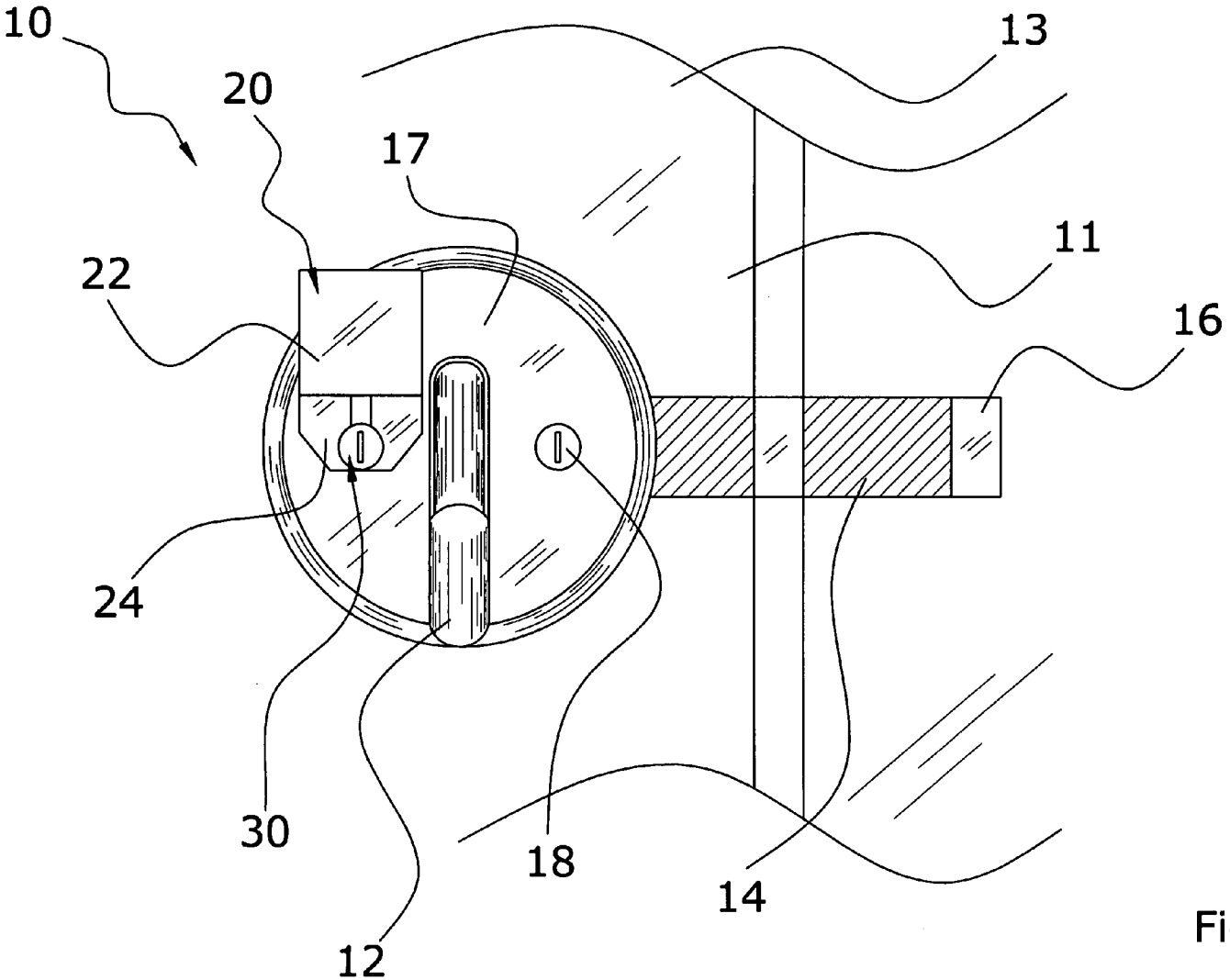
FIG. 3*b* is a front view of the present invention connected to an existing dead bolt mechanism in an intermediate position.
Figure 3C:
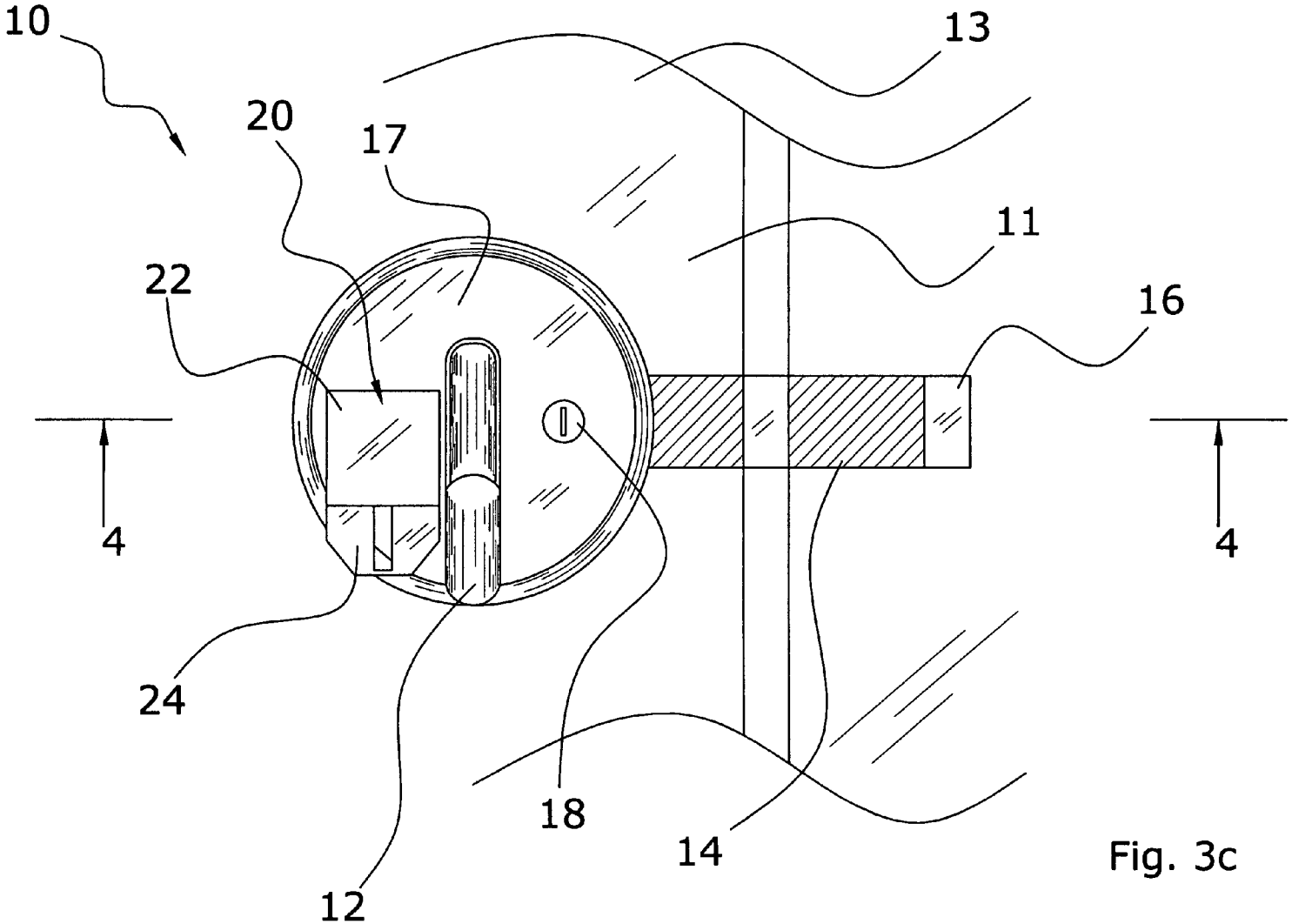
FIG. 3*c* is a front view of the present invention connected to an existing dead bolt mechanism preventing the dead bolt from opening.
Figure 4:
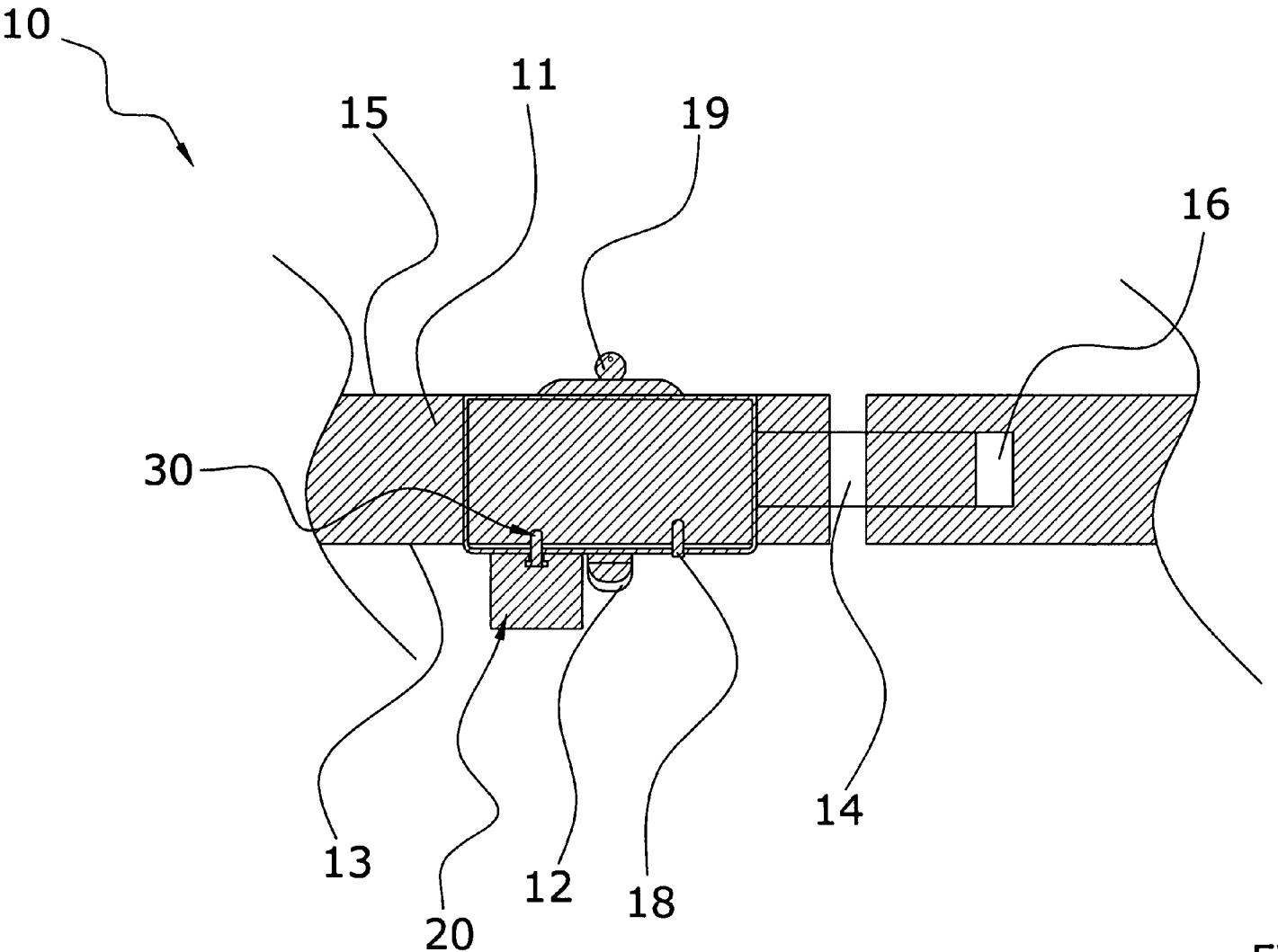
FIG. 4 is a top view of the present invention connected to an existing dead bolt mechanism preventing the dead bolt from opening.

As shown in FIGS. 3*a* through 4, the lock guard system 10 is preferably attached to the covering plate 17 of a dead bolt mechanism. The lock guard system 10 preferably uses the existing aperture of a removed existing fastener 18 used in the covering plate 17 and door 11. A sleeve 32 and fastener 30 are extended through the lower slot 28 located in the plate 24 into the existing aperture to attach the stop member 20 to the dead bolt mechanism. As can be appreciated by one skilled in the art, an aperture could be added to a dead bolt mechanism if one is not available for mounting the lock guard system 10.

The fastener 30 retains the stop member 20 to the dead bolt mechanism, while the sleeve 32 permits rotation and slide adjustment of the stop member 20 within the lower slot 28. The adjustment allows for different orientations of the stop member 20 to perform different functions.

As shown in FIG. 3*a*, the stop member is orientated horizontally. In this position, the dead bolt mechanism functions in its normal fashion from both the inside 13 and outside 15. In this position, the knob 12 is able to rotate over the plate 24 portion of the stop member 20. As shown in FIG. 3*a*, this orientation allows a user to be able to rotate the knob 12 from the inside 13 and disengage the bolt 14 from the receiver aperture 16 in the wall adjacent to the door 11. It also allows a user to utilize a key 19 to disengage the bolt 14 from the receiver aperture 16 in the wall adjacent to the wall to gain access from the outside 15.

As illustrated in FIG. 3*b*, the stop member 20 is orientated vertically in an intermediate step of either locking or unlocking the dead bolt mechanism. In this position, the stop member 20 has been rotated about the fastener 30 prior to engaging the lock guard system 10 or has been slid vertically within the lower slot 28 to disengage the lock guard system 10.

As shown in FIG. 3*c*, the stop member 20 is again orientated vertically, but is placed in the engaged locking position for the lock guard system 10. Positioned as such, the knob 12 of the dead bolt mechanism is unable to rotate to allow disengagement of the bolt 14 from the receiver aperture 16. In this position only a user on the inside 13 of the door 11 is able to disengage the stop member 20 as shown in FIG. 3*a* and allow the dead bolt mechanism to be unlocked. A user attempting to unlock the dead bolt mechanism from the outside 15 by means of a key 19 as shown in FIG. 4 or other methods (e.g. pick tool) is essentially unable to.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A lock guard system, comprising:

a dead bolt mechanism including a dead bolt member, a covering plate, a knob and at least one aperture, wherein said covering plate is attached to an inside of a door;

wherein said knob extends outwardly from said covering plate and wherein said at least one aperture extends through said covering plate;

wherein said knob selectively rotates about said door;

a stop member including a first portion and a second portion, wherein said first portion extends from said second portion;

wherein a first thickness of said first portion is substantially less than a second thickness of said second portion;

wherein said knob selectively rotates over said first portion and wherein said knob is unable to rotate over said second portion;

wherein said stop member includes a first slot extending through said first portion and wherein said stop member includes a second slot extending within said second portion;

wherein said first slot and said second slot form a T-shaped cross section;

a sleeve positioned within said first slot, wherein said sleeve slidably moves within said first slot; and a fastener extending through said sleeve and within said at least one aperture of said dead bolt mechanism, wherein said fastener attaches said stop member and said sleeve to said dead bolt mechanism;

wherein said stop member slidably and rotatably adjusts about said sleeve.

2. The lock guard system of claim 1, wherein said first portion and said second portion share a common surface, wherein said first slot extends through said common surface.

3. The lock guard system of claim 1, wherein a first cross-sectional width of said first slot is substantially less than a second cross-sectional width of said second slot.

4. The lock guard system of claim 1, wherein a head of said fastener is slidably positionable within said second slot.

5. The lock guard system of claim 1, wherein a first height of said first slot is substantially similar to a second height of said sleeve.

6. The lock guard system of claim 1, wherein at least one of said first and second portions engaged said covering plate.

7. The lock guard system of claim 1, wherein said second slot aligns with said first slot.

8. The lock guard system of claim 1, wherein said first slot and said second slot collectively receive said fastener.

9. The lock guard system of claim 1, wherein said first slot is comprised of an elongated configuration.

10. The lock guard system of claim 1, wherein said fastener perpendicularly intersects a first longitudinal axis of said first slot.

11. The lock guard system of claim 1, wherein said fastener perpendicularly intersects a second longitudinal axis of said second slot.

12. The lock guard system of claim 1, wherein said first portion is positionable between said knob and said covering plate.

13. The lock guard system of claim 1, wherein said first slot is positionable between said knob and said covering plate.

14. The lock guard system of claim 1, wherein said second portion is engageable by said knob.

15. The lock guard system of claim 1, wherein said second slot extends from said first slot.

16. A lock guard system, comprising:

a dead bolt mechanism including a dead bolt member, a covering plate, a knob and at least one aperture, wherein said covering plate is attached to an inside of a door;

wherein said knob extends outwardly from said covering plate and wherein said at least one aperture extends through said covering plate;

wherein said knob selectively rotates about said door;

a stop member including a first portion and a second portion, wherein said first portion extends from said second portion;

wherein a first thickness of said first portion is substantially less than a second thickness of said second portion;

wherein said knob selectively rotates over said first portion and wherein said knob is unable to rotate over said second portion;

wherein said stop member includes a first slot extending through said first portion and wherein said stop member includes a second slot extending within said second portion;

wherein said first slot and said second slot form a T-shaped cross section;

a sleeve positioned within said first slot, wherein said sleeve slidably moves within said first slot; and a fastener extending through said sleeve and within said at least one aperture of said dead bolt mechanism wherein said fastener attaches said stop member and said sleeve to said dead bolt mechanism;

wherein said stop member slidably and rotatably adjusts about said sleeve;

wherein said first portion and said second portion share a common surface, wherein said first slot extends through said common surface;

wherein a first cross-sectional width of said first slot is substantially less than a second cross-sectional width of said second slot;

wherein a first height of said first slot is substantially similar to a second height of said sleeve;

wherein at least one of said first and second portions engage said covering plate;

wherein said second slot aligns with said first slot;

wherein said first slot and said second slot collectively receive said fastener;

wherein said second slot extends from said first slot.

17. The lock guard system of claim 16, wherein said fastener perpendicularly intersects a first longitudinal axis of said first slot.

18. The lock guard system of claim 16, wherein said fastener perpendicularly intersects a second longitudinal axis of said second slot.

19. The lock guard system of claim 16, wherein said first portion is positionable between said knob and said covering plate.

20. A lock guard system, comprising:

a dead bolt mechanism including a dead bolt member, a covering plate, a knob and at least one aperture, wherein said covering plate is attached to an inside of a door;

wherein said knob extends outwardly from said covering plate and wherein said at least one aperture extends through said covering plate;

wherein said knob selectively rotates about said door;

a stop member including a first portion and a second portion, wherein said first portion extends from said second portion;

wherein a first thickness of said first portion is substantially less than a second thickness of said second portion;

wherein said knob selectively rotates over said first portion and wherein said knob is unable to rotate over said second portion;

wherein said stop member includes a first slot extending through said first portion and wherein said stop member includes a second slot extending within said second portion;

wherein said first slot and said second slot form a T-shaped cross section;

a sleeve positioned within said first slot, wherein said sleeve slidably moves within said first slot; and a fastener extending through said sleeve and within said at least one aperture of said dead bolt mechanism, wherein said fastener attaches said stop member and said sleeve to said dead bolt mechanism;

wherein said stop member slidably and rotatably adjusts about said sleeve;

wherein said first portion and said second portion share a common surface, wherein said first slot extends through said common surface;

wherein a first cross-sectional width of said first slot is substantially less than a second cross-sectional width of said second slot;

wherein a head of said fastener is slidably positionable within said second slot;

wherein a first height of said first slot is substantially similar to a second height of said sleeve;

wherein at least one of said first and second portions engage said covering plate;

wherein said second slot aligns with said first slot;

wherein said first slot and said second slot collectively receive said fastener;

wherein said first slot is comprised of an elongated configuration;

wherein said fastener perpendicularly intersects a first longitudinal axis of said first slot and wherein said fastener perpendicularly intersects a second longitudinal axis of said second slot;

wherein said first portion is positionable between said knob and said covering plate;

wherein said first slot is positionable between said knob and said covering plate and wherein said second portion is engageable by said knob;

wherein said second slot extends from said first slot.

* * * * *